United States Patent [19]

Bascle, Jr.

[11] 4,257,378

[45] Mar. 24, 1981

[54] UPGRADER VARIABLE PRESSURE REGULATOR

[76] Inventor: Joseph A. Bascle, Jr., Baton Rouge, La.

[21] Appl. No.: 39,423

[22] Filed: May 15, 1979

Related U.S. Application Data

[63] Continuation of Ser. No. 928,579, Jul. 27, 1978, abandoned, which is a continuation of Ser. No. 775,011, Mar. 7, 1977, abandoned.

[51] Int. Cl.[3] ..... F02M 59/20

[52] U.S. Cl. ..... 123/512; 123/514

[58] Field of Search ..... 123/140 MP, 136, 139 AV, 123/139 AW; 137/505.42

[56] References Cited

U.S. PATENT DOCUMENTS

| | | | |
|---|---|---|---|
| 2,615,287 | 10/1952 | Senesky | 137/505.42 |
| 2,638,912 | 5/1953 | Lee | 123/139 AW |
| 2,843,096 | 7/1958 | Dolza et al. | 123/139 AW |
| 3,552,431 | 1/1971 | Schmidlin | 137/505.42 |
| 3,736,912 | 6/1973 | Okura et al. | 123/140 MP |
| 3,824,974 | 7/1974 | LaFlame et al. | 123/136 |
| 4,044,746 | 8/1977 | Kaye | 123/139 AV |
| 4,094,337 | 6/1978 | Robinson | 137/505.42 |
| 4,153,026 | 5/1979 | Nagano et al. | 123/139 AW |

FOREIGN PATENT DOCUMENTS

| | | | |
|---|---|---|---|
| 1058401 | 3/1954 | France | 137/505.42 |

*Primary Examiner*—P. S. Lall

*Attorney, Agent, or Firm*—C. Emmett Pugh & Associates, Ltd.

[57] ABSTRACT

There is disclosed a new and improved air-fuel metering regulator which provides for extremely fine adjustment of the flow of fuel to the internal combustion engine which may be operating under idling, cruising or various accelerating power circumstances. This is provided, in the preferred embodiment, by the novel arrangement of the separate air and fuel diaphragm and chambers with extremely fine adjustments being provided in both the air or vacuum chamber bodies and the fuel chamber bodies to limit the travel of both diaphragm assemblies in their respective linear directions toward or away from the vacuum or fuel chamber bodies. As a result of the fine adjustments possible and the particular layout of the chambers, more precise and upgraded performance is available in the internal combustion engine as a result of the fuel supply to the internal combustion engine being made more responsive to the various operating conditions of the engine.

7 Claims, 7 Drawing Figures

UPGRADER VARIABLE PRESSURE REGULATOR

This is a continuation of application Ser. No. 928,579, filed July 27, 1978, now abandoned, entitled "Upgrade Variable Pressure Regulator" which is a continuation of application Ser. No. 775,011, filed Mar. 7, 1977 of the same title, now abandoned.

BACKGROUND OF THE INVENTION

1. Field of the Invention

The present invention relates to fuel metering systems associated with, for example, internal combustion engines and more particularly relates to a pressure regulator which adjustably meters fuel flow to a carburetor or the like, fuel adjustments corresponding to changes in engine operating conditions such as vacuum pressure changes.

2. General Discussion and Prior Art

With the increase in cost of all types of energy, and especially with the increase in cost of fuel for transportation, a great need exists for devices which more efficiently meter fuel to an engine and still maintain proper engine operation.

It is a generally known fact that vacuum pull, in terms of inches of mercury, varies accordingly with engine operating conditions, in terms of throttle movement, engine loads and engine speeds. It logically follows that by limiting the fuel pressures to desireable minimum levels for each or most of these variable engine operating conditions, this should most certainly prove most beneficial for energy conservation.

A major object of the present invention is to provide a simplified, but completely variable precisely adjustable fuel pressure regulator in order to precondition a fuel supply in terms of pressure values subject to the known requirement of fuel metering systems being used.

Additionally, an object of the present invention is to modify fuel pump characteristics more favorably under various engine operating conditions. With the present invention, the fuel supply metered to a carburator can be adjusted under any of the following varying operating conditions: (1) when operating conditions are influenced by the temperature, (2) when idling, (3) when operating conditions are influenced by throttle position or movement, (4) when operating conditions are influenced by various loads, accelerating, or cruising, (5) when operating conditions are influenced by varying speeds, cruising and high speeds or low speeds, and (6) when operating conditions are influenced by simultaneous loads and speeds such as low speed acceleration and high speed cruising and/or high speed acceleration and low speed cruising.

The vacuum pressure normally rises within an internal combustion engine when the engine experiences low loads and idling. In such instances the vacuum pressure is normally, for example, eighteen (18) to twenty (20) inches of mercury. When the loads are very low on the engine, such as when idling or cruising, and pressures are high, it is desireable to have a minimum amount of fuel flowing to the carburetor. The present invention provides an air-fuel metering pressure regulator which utilizes an engine vacuum pressure to vary the quantity of fuel which flows through the metering system to the carburator under varying operating conditions. The device makes changes in the quantities of fuel flowing to the carburator based on changes in the vacuum pressure of the engine.

Another object of the invention is to provide accessible or external means by which the pressure regulator of the present invention can be independently varied and preset by means of extremely fine thread adjustments.

Another object of the invention is to provide an independent assembly specifically constructed for installations within any available space between a fuel metering system and the fuel pump itself such as occurs within replacement markets, per se.

Another object of the invention is to provide an upgrader variable pressure regulator, in all respects internally similar as herein described excepting that the outer housing configurations can be changed for anticipated and unitized construction or assembly as a component part of a fuel metering system proper as may apply in the case of original markets.

3. General Discussion of the Present Invention

The present invention in the preferred embodiment is comprised of a housing having two cooperating half bodies. First, a vacuum chamber body and secondly a fuel chamber body. The vacuum chamber and fuel chamber bodies are joined together with the face portions enclosing a larger vacuum diaphragm therebetween. This diaphragm is provided with a central diaphragm clamp screw which abuts alternatively a similar but smaller fuel diaphragm clamp screw in the central part thereof. The general configuration shows that the inner portion of each half body are specifically recessed to provide (a) employing a ventilated diaphragm support ring on the vacuum side of the large diaphragm, and (b) a ventilated compression chamber between both large and small diaphragms, and (c) a reduced fuel metering chamber directed to allow the central fuel diaphragm clamp screw to directly activate the fuel needle protruding therein; but limited to the movements of the large vacuum diaphragm as controlled by a vacuum/-spring reactions of the travel limits established and opposed by extremely fine adjustable travel control screws, per se.

Thus within the vacuum chamber body, this provides greater and faster responses from the alternate vacuum levels while the independent and smaller fuel chamber diaphragm consequently offers less resistance, despite being influenced by varying fuel pump pressures. This arrangement allows close proximity and direct contact between both diaphragms and the fuel metering needle for quick reactionary responses due to vacuum changes; while still providing two opposing but finely adjustable travel stop screws by which to limit low and high fuel pressure levels.

The vacuum chamber is provided with a vacuum connection tap to which a vacuum source, such as the vacuum line from the inlet manifold of a internal combustion engine can be connected. Changes in vacuum pressure reciprocate the large diaphragm alternately toward the control screws of both diaphragms and away from the needle valve thereby closing the needle valve against an associated seat, thus restricting the flow of fuel through the device, away from the vacuum diaphragm control-stop screw towards the needle valve thereby allowing greater flow of fuel through the device. The fuel chamber body is provided with a fuel entry connection from the fuel pump and a fuel outlet connection for alignment with the carburetor or fuel metering system employed. Further, it is recommended that a restricted fuel by-pass line be connected with the fuel supply tank in order to prevent or eliminate the accumulation of air-pockets generally created by the fuel pump itself, particularly when used with all-pressure systems and ideally shown by FIG. 1.

An alternative embodiment provides a single diaphragm in place of the two diaphragms (the vacuum diaphragm and the fuel diaphragm) of the preferred embodiment. An alternate embodiment of the needle valve arrangement provides for the needle valve to be attached to the fuel chamber diaphragm in order to achieve greater flexibility and control of the pressurized fuel in order to obtain precise fuel metering.

BRIEF DESCRIPTION OF THE DRAWINGS

For a further understanding of the nature and objects of the present invention, reference should be had to the following detailed description taken in conjunction with the accompanying drawings in which like parts are given like reference numerals and wherein.

DETAILED DESCRIPTION OF THE PREFERRED EMBODIMENT

STRUCTURE

Figure 1:
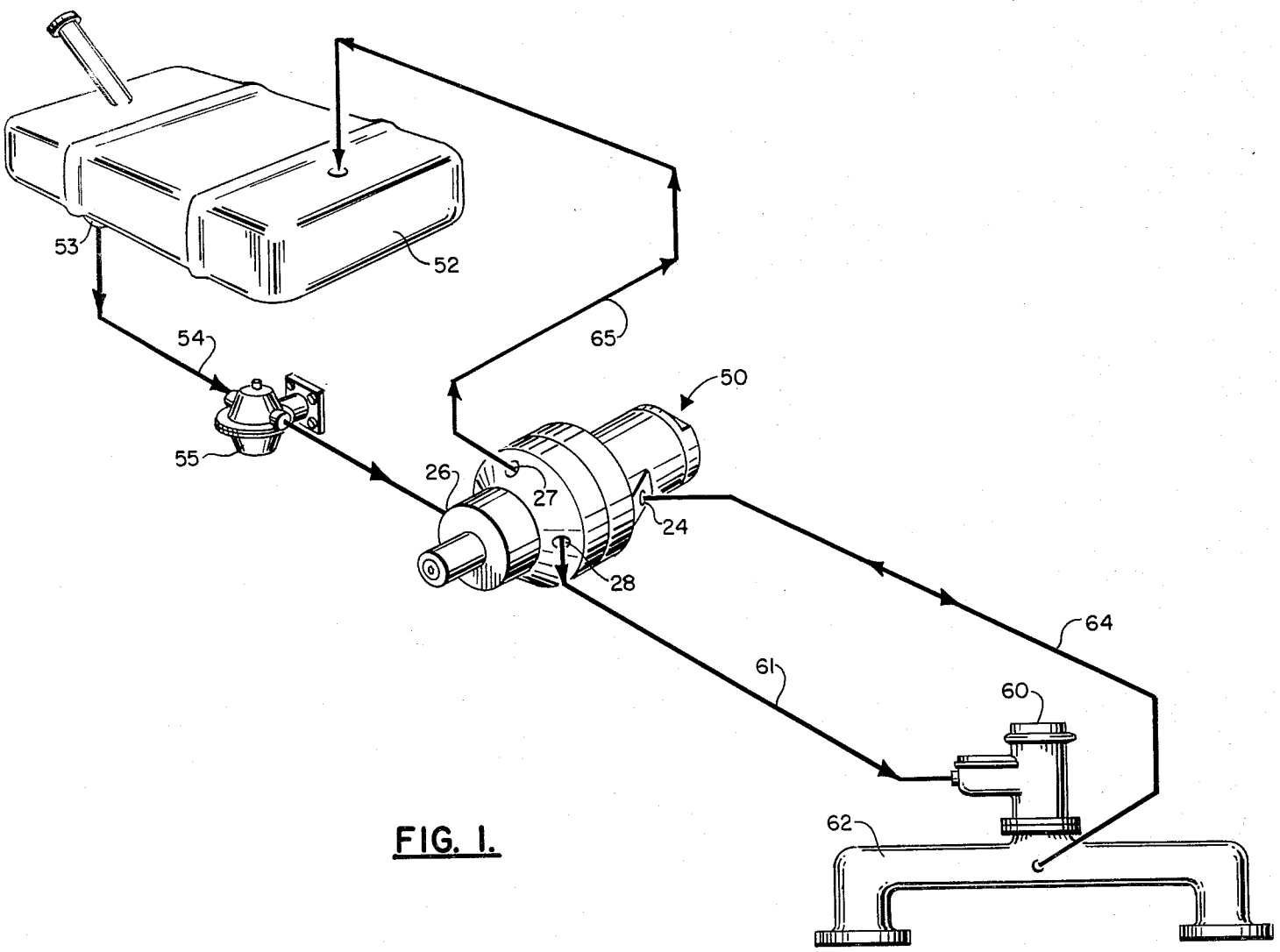
FIG. 1 is a schematic diagram of the preferred embodiment of the apparatus of the present invention placed in typical fuel metering system.

Referring now to the drawings, FIG. 1 best illustrates a schematic diagram of the placement of the preferred embodiment of the regulator apparatus of the present invention, designated generally by the numeral 50, located in a typical fuel metering system.

In FIG. 1, there can be seen a fuel storage tank 52 which contains fuel necessary to operate any conventional internal combustion engine such as gasoline or the like. Fuel leaves the tank 52 through outlet 53 and enters fuel line 54 which conveys fuel to any conventional type fuel pump designated by the numeral 55. The fuel pump then pumps fuel to the fuel entry 26 where it enters regulator 50. Fuel entry 26 is preferably at the elevational midpoint of regulator 50.

Fuel exits regulator 50 at fuel outlet 28 where it flows through fuel supply line 61 to a fuel metering system or conventional carburetor, designated by the numeral 60 in FIG. 1. The fuel by-pass line 65 allows a recirculation of fuel to tank 52 and is preferably located at the elevational high point of the regulator 50. The flow through by-pass line 65 is normally much less than the flow through supply line 61 and is normally on the order of a drip, as by-pass line 65 functions primarily as a "bleed" line to remove air from regulator 50 thereby insures proper performance. However, in the case of all-pressure systems, the fuel line 61 transferring fuel to ap-systems should originate preferably from a mid-point of the regulator as shown in FIG. 1 in order to avoid entrapped air pockets which normally accumulate during operations. Fuel leaving the carburetor operates any conventional type engine as is well known in the art. Inlet manifold, designated by the numeral 62, provides a source of vacuum through vacuum line 64 and is attached to regulator 50 at vacuum connection tap 24. As will be described more fully hereinafter, vacuum line 64 provides the source of vacuum corresponding to engine vacuum pressure to operate the variable pressure regulator 50 of the present invention.

Figure 2:
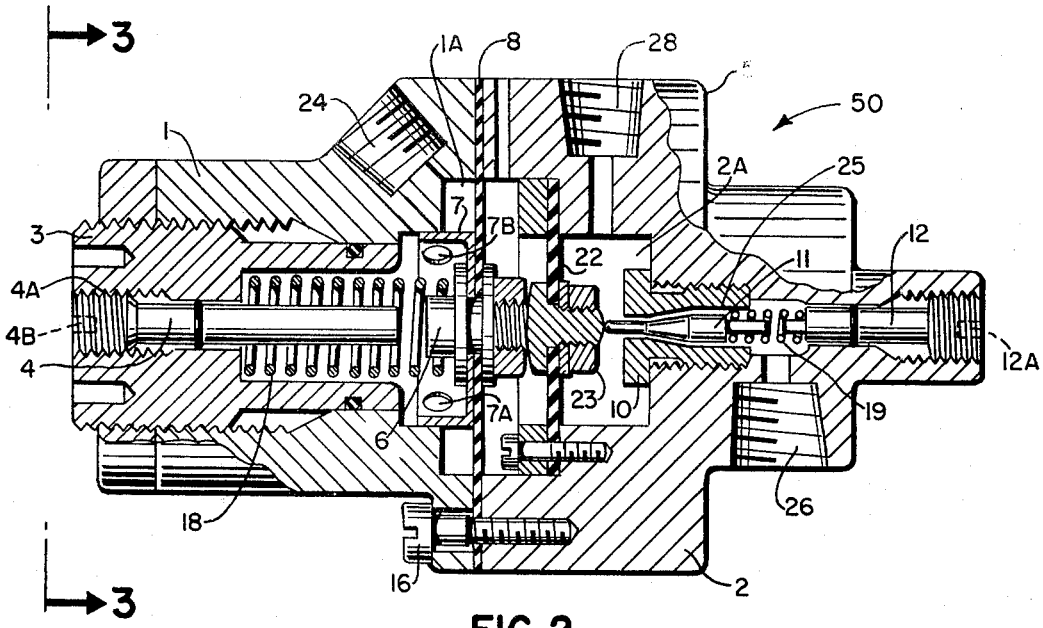
FIG. 2 is a top cross sectional view of the preferred embodiment of the apparatus of the present invention.
Figure 3:
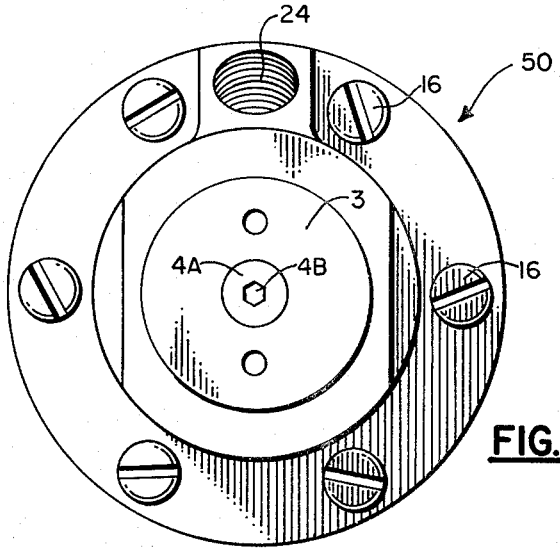
FIG. 3 is a side view taken along lines 3—3 of FIG, 2.
Figure 4:
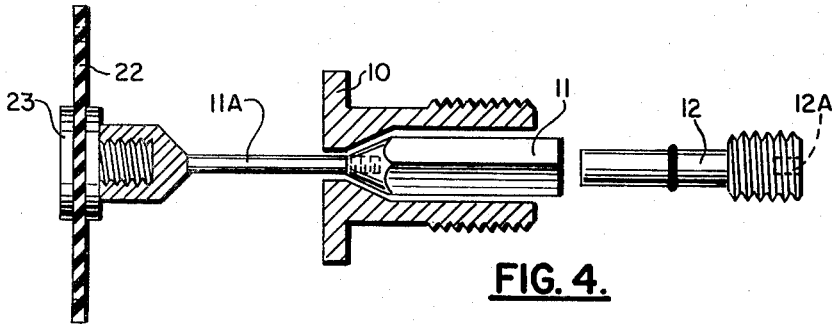
FIG. 4 is a side view of an alternative embodiment of the needle valve and fuel diaphragm linkage shown in FIG. 2.

FIGS. 2–4 illustrate with detail the preferred embodiment of variable pressure regulator 50 of the present invention. As can best be seen by FIG. 2, regulator 50 is provided with an outer housing 51 which is comprised of two half bodies, a vacuum chamber body 1 and a fuel chamber body 2. Both the vacuum chamber body 1 and fuel chamber body 2 are provided with connectable face portions which abut and join together using philister head screws 16 and thereby sandwich vacuum diaphragm 8 therebetween. Each body 1, 2 has a central annular chamber portion designated by the numerals 1A and 2A respectively in FIG. 2. The chamber associated with vacuum chamber body 1, is designated by the numeral 1A and provides a vacuum chamber. The chamber associated with fuel chamber body 2 is designated by the numeral 2A and provides a fuel chamber.

Fuel chamber body 2 is provided with a fuel inlet 26 and a fuel outlet 28. Fuel inlet 26 allows fuel to enter regulator 50 from feed line 54, where it flows through a central conduit 25 into fuel chamber 2A. Central conduit 25 through which fuel flows from inlet 26 to fuel chamber 2A is provided with needle valve 11. Needle valve 11 controls the volume of fuel which flows from inlet 26 to fuel chamber 2A and is actuated by fuel diaphragm 22 and its associated vacuum diaphragm 8 as will be more fully discussed hereinafter.

Needle valve 11 is provided with a needle valve seat 10 which can be threadably mounted in fuel body 2 as is shown best by FIG. 2. Needle valve seat 10 is also mounted from within fuel body 2 (before the device is assembled) from the inner face of fuel chamber body 2 through fuel chamber 2A. The inner portion of needle seat 10 is shaped so as to sealably receive needle valve 11 and thereby make a substantially fluid tight seal therewith when needle valve 11 seats against seat 10. Needle valve 11 is provided with needle spring 19 which urges needle valve 11 to a closed position. The distance which needle valve 11 can move away from fuel diaphragm 22 (which corresponds to maximum fuel flow) is precisely controlled by an extremely fine fuel adjustment screw 12. Fuel adjustment screw 12 can be adjusted from the outside portion of fuel chamber body 2 at recess 12A as can be seen in FIG. 2. It can be seen by one skilled in the art that the setting of the extremely fine fuel adjustment screw 12 precisely controls the distance that needle valve 11 can open from seat 10 and also precisely adjusts thereby the maximum volume of fuel which can flow from fuel entry 26 into fuel chamber 2A. Threads of adjustment screw 12 would be very fine to provide a maximum sensitivity and the coarse threads shown in the various patent drawing figures are drawn as coarse threads for convenience only and do not represent the actual size of the extremely fine threads.

FIG. 4 illustrates an alternate linkage between fuel diaphragm 22 and associated needle valve 11 which provides greater flexibility and control of the fuel for precise metering. The needle valve 11 is directly connected to diaphragm 22 by means of link member 11A. This configuration provides a most sensitive response of needle valve 11 to movement of fuel diaphragm 22 and thereby the most precise metering. In the alternative linkage of FIG. 4, there is still provided an extremely fine fuel adjustment screw 12 which affixes the maximum open position of needle valve 11 from seat 10. Adjustment of the very fine screw 12 is external by means of recess 12A which can be a conventional hexagonal recess capable of receiving an allen wrench therein.

Vacuum chamber body 1 is provided with vacuum chamber 1A which abuts vacuum diaphragm 8. Vacuum diaphragm 8 is sandwiched between vacuum chamber body 1 and fuel chamber body 2. The central portion of vacuum diaphragm 8 is provided with an attached diaphragm clamp screw 6 and associated support ring 7. Support ring 7 is preferably annular and is slideably receivable within a provided recessed annular portion of vacuum chamber 1A. Diaphragm support ring 7 is provided with a plurality of ventilation ports 7A–7B which insure uniform vacuum pressure throughout vacuum chamber 1A. Vacuum diaphragm 8 is urged towards needle valve 11 by diaphragm spring 18. Diaphragm spring 18 engages at its respective end portions diaphragm clamp screw 6 and very fine spring adjustment screw 3. Spring adjustment screw 3 is threadably (using extremely fine threads) mounted through the central portion of vacuum chamber body 1. The threads shown in the patent drawing for the spring adjustment screw are shown as coarse threads for convenience sake only but it should be understood that in actual practice these threads would be made very fine in order to provide precise adjustment. It can be seen by one skilled in the art that changes in the threaded position of the very finely threaded spring adjustment screw 3 (i.e., its distance from vacuum diaphragm 8) within vacuum chamber imparts different and precisely adjustable compression on diaphragm 8 by pressing on diaphragm spring 8. Additionally, different diaphragm springs 18 can be placed within vacuum chamber body 1 as shown in FIG. 2, which springs may have varying spring characteristics to impart various pressures on diaphragm 8 as required by engineering studies. The central portion of the finely adjustable spring screw 3 is provided with an inner threaded annular bore 4A through which the vacuum diaphragm travel control screw 4 is threadably mounted. Inspection of FIG. 2 will show that the maximum distance which vacuum diaphragm clamp screw 6 and the attached vacuum diaphragm 8 can move away from needle valve seat 10 is adjustably fixed by adjusting the finely threaded diaphragm control screw 4, which acts as a stop. Likewise, control screw 4 limits the travel distance of fuel diaphragm 22 and abutting needle valve 11, thus providing an extremely fine adjustment to the minimal amount of fuel which can flow through needle valve 11 to fuel chamber 2A. These threaded members as has been mentioned before are provided with very fine threads to provide maximum sensitivity an adjustability in the regulator.

It can be seen that reciprocations of vacuum diaphragm 8 and fuel diaphragm 22 are controlled in the direction towards the vacuum chamber body 1 by the finely adjustable diaphragm control screw 4 and, in the direction of the fuel chamber body by the finely adjustable fuel control and adjustment screw 12 which abuts and stops movement of fuel diaphragm clamp screw 23. Normally needle valve 11 abuts fuel diaphragm clamp screw 23 (as is shown in FIG. 2), which position affixes the location of needle valve 11 within seat 10 and thus the corresponding flow of fuel through fuel entry 26 to fuel chamber 2A.

It can be seen by one skilled in the art that reciprocations in vacuum diaphragm 22 and a fluctuation in needle valve 11 either to or from fuel diaphragm 22 provides a varying volume of flow through the needle valve 11 responsive to engine vacuum pressure. It can also be seen that the minimum and maximum flow quantities are fully adjustable.

Vacuum chamber body 1 is provided with a vacuum connection 24 to which a vacuum source can be connected. The vacuum connection allows a vacuum source to impart different vacuum pressures to vacuum chamber 1A. In the preferred embodiment, as can best be seen by FIG. 1, the vacuum connection 24 received a vacuum line from, for example, the inlet manifold of any conventional engine. It can be seen from an inspection of FIG. 2, that variations in pressure applied to vacuum connection 24 will cause a pressure variation in vacuum chamber 1A and a corresponding reciprocation of vacuum diaphragm 8. It can readily be seen that a decrease in vacuum pressure in line 64 and thus in vacuum chamber 1A will cause diaphragm 8 to expand in the direction of fuel diaphragm 22 and needle valve 11, thus opening said valve 11 and allowing a greater flow of fuel into fuel chamber 2A. Correspondingly, an increase in vacuum pressure in vacuum line 64 causes a substantially identical increase of pressure in vacuum chamber 1A and a contraction of diaphragm 8 in the direction of diaphragm control screw 4 and away from needle valve 11. With such a contraction of diaphragm 8, needle valve 11 is urged towards seat 10 by needle spring 19, thus effecting a reduction in fuel flow.

From the foregoing, one can readily see that high vacuum pressures in vacuum chamber 1A will cause a decrease in the amount of fuel flowing through regulator 50, while low vacuum pressures in vacuum chamber 1A will correspondingly increase the amount of fuel flowing through the regulator 50.

The present invention provides a totally externally finely adjustable regulator 50. The maximum distance at which needle valve 11 can open is absolutely fixed by the finely threaded fuel adjustment screw 12 having external adjustment recess 12A. Such an adjustment feature can be, for example, a recess which can receive a conventional allen wrench for making adjustments of fuel control and adjustment screw 12 to withdraw or penetrate adjustment screw 12 towards the needle valve 11. Likewise, the travel of diaphragm clamp screw 6 away from needle valve 11 is limited by vacuum diaphragm travel control screw 4, also externally finely adjustable at recess 4B. It can be seen that a setting of diaphragm control screw 4 precisely fixes the distance at which needle valve 11 can close, thus limiting the minimum amount of fuel that can flow through the valve 11.

Vacuum diaphragm control spring 18 and needle spring 19 can be of any type of conventional spring and can be interchanged to give a wide span of desired spring characteristics, and thus a great flexibility to the regulator 50 of the present invention. It can be seen from the drawings and the foregoing discussion that it is only a matter of engineering design to change the regulator of the present invention to fit any number of a variety of fuel metering systems. By utilizing a wide span of differing springs 18, 19, each having different spring characteristics and likewise a corresponding wide span of diaphragms 8, 22 a substantally universal flexibility can be achieved.

With a variety of diaphragm springs 18, 19 used to give different compressions to diaphragm clamp screw and needle valve 11 respectively, such changing of each individual spring 18, 19 provides a "course" adjustment to the regulator 50. A "fine" adjustment is provided to any diaphragm springs 18, 19 selected for use by the finely adjustable diaphragm travel control screw 4 and by the finely adjustable fuel adjustment screw 12. It can be seen by one skilled in the art, that adjustably rotating the fine adjustment screws 4 and 12 will impart different stiffnesses to springs 18 and 19, while additionally limiting a travel of diaphragm clamp screw and associated needle valve 11 as described above.

Both the travel in either direction of diaphragm 8, (and thus fuel flow), and the stiffness of springs 18 and 19, can be externally controlled using the aforementioned fine adjustment control screws 4 and 12. The adjustability referred to above as "course" adjustment can also be achieved from the exterior, by removal of spring adjustment screw 3 to add diaphragm spring 18 or by removal of fuel control and adjustment screw 12 to remove diaphragm spring 19. These adjustments can be accomplished independently at any time either spring is desired to be replaced, giving a wide adjustability to the variable regulator 50 of the present invention. All adjustments are externally made, and regulator 50 can be an operating system at the time.

Figure 5:
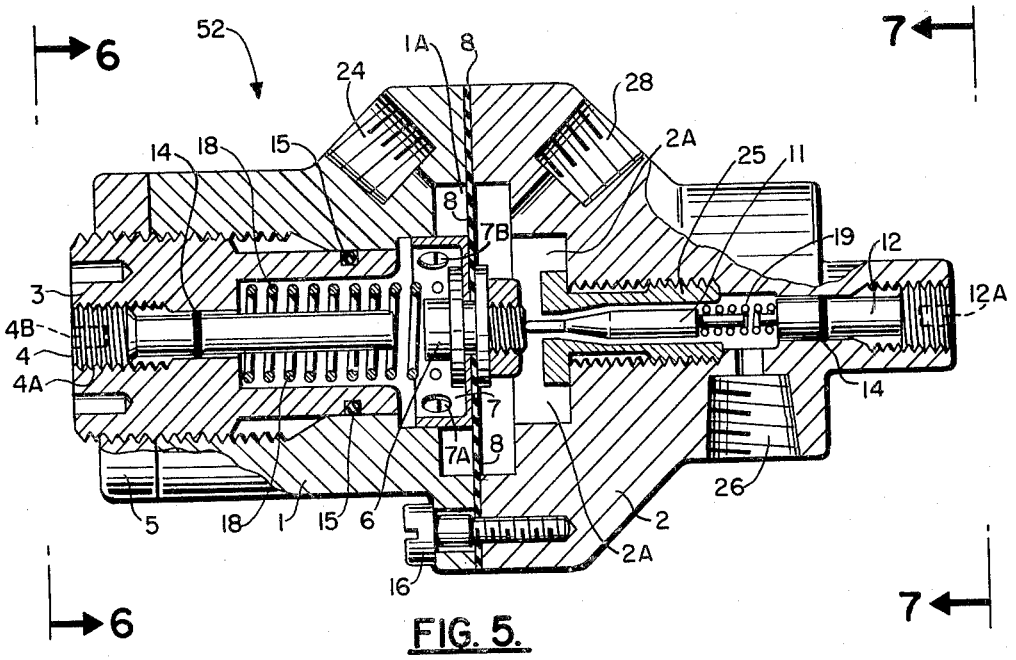
FIG. 5 is a cross sectional view of an alternative embodiment of the apparatus of the present invention.
Figure 6:
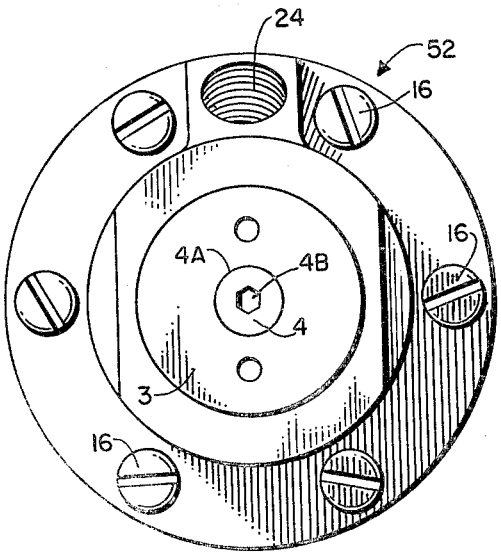
FIG. 6 is a sectional view taken along lines 6—6 of FIG. 5.
Figure 7:
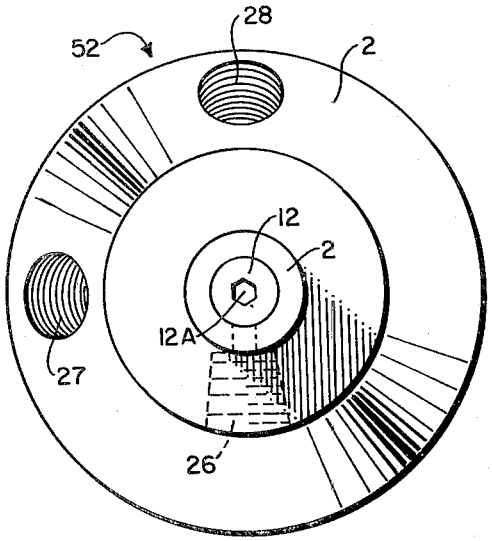
FIG. 7 is a side view taken along lines 7—7 of FIG. 5.

FIGS. 5–7 provide an alternative embodiment of the apparatus of the present invention. As can best be seen in FIG. 5, regulator 52 of the alternative embodiment provides a pair of half bodies, 1 and 2 which abut to sandwich diaphragm 8 therebetween. Half body 1 provides a vacuum chamber body while half body 2 provides a fuel chamber body 2. Fuel inlet 26 allows the entrance of fuel into regulator 52 at fuel chamber body 2. Fuel can flow through conduit 25 into fuel chamber 2A. Conduit 25 is provided with needle valve 11 which is slidably mounted in needle valve seat 10 and can form a sealable substantially fluid tight seal therewith. Needle valve 11 is urged towards needle seat 10 by spring 19. The maximum distance which needle valve 11 can open from seat 10 is controlled by a finely threaded adjustment screw 12 which can be externally adjusted at slot 12A. A fuel outlet 27 is provided for the discharge of fuel from fuel chamber 2A.

In the alternative embodiment, as is best illustrated in FIG. 5, a single diaphragm 8 is provided as opposed to the dual diaphragm structure of the preferred embodiment. Diaphragm 8, is provided with a support sleeve 7 which is slidably received within an annular recess within vacuum chamber 1A. Vacuum chamber 1A is provided with a vacuum line 24 to which a vacuum source can be attached. Ventilation port 7, 7A allow vacuum to uniformly cooperate with the entire area of vacuum chamber 1A. Stop screw 4 is provided with fine threads and is provided to limit the travel of diaphragm 8 in the direction of vacuum chamber body 1A. Adjustments of a very precise nature can be provided to stop screw 4 at slot 4B. Diaphragm 8 is urged towards needle valve 11 by means of spring 18 and a supply of vacuum to vacuum line 24 would urge diaphragm 8 towards vacuum chamber body 1.

O rings 15 can be provided as needed to form substantially fluid tight seals and ensure proper performance of regulator 52. The assembly of half bodies 1 and 2 is achieved by means of philister head screw 16. Diaphragm clamp screw 6 is provided which can abut alternatively stop screw 4 or needle valve 11.

Regulator 52 can be constructed of any suitable rigid material such as any structural metals, for example steel, iron, aluminum and the like. Diaphragm 8 can be any flexible diaphragm material such as neoprene.

OPERATION

In operation, the regulator 50 of the present invention can be utilized with any type of fuel metering system. As can be seen in FIG. 1, regulator 50 can be positioned between a conventional fuel pump 55 and any type of fuel metering unit or conventional carburetor designated by the numeral 60 in FIG. 1. Actuation of the diaphragm 8 inside regulator 50 is effected by the attachment of vacuum line 64 to vacuum connection tap 24. The opposite end portion of vacuum line 64 is placed on any portion of the engine which will transmit an accurate vacuum corresponding to engine vacuum pressure to the vacuum chamber 1A of regulator 50. As the engine operates, changes in vacuum (as occur in the inlet manifold, designated by the numeral 62 in FIG. 1), will also produce a vacuum transmitted through vacuum line 64 to vacuum chamber 1A. It is this vacuum, produced within chamber 1A, which causes reciprocation of diaphragms 8 and 22 and associated needle valve 11.

The introduction of a high vacuum pressure reading causes a movement of diaphragms 8 and 22 and clamp screw 6 towards the vacuum chamber body 1 and its inwardly mounted diaphragm travel control screw 4. Such movement of clamp screw 6 contracts vacuum diaphragm 8 and spring 19 urges needle valve 11 to move in a direction towards diaphragm clamp screw 6 closing the opening through which fuel can flow from inlet 26 to fuel chamber 2A.

Conversely, a drop in engine vacuum pressure in chamber 1A (as transmitted from inlet manifold 62 to vacuum line 64), will cause vacuum diaphragm 8 and clamp screw 6 to reciprocate towards needle valve 11 pushing diaphragm 22 and needle valve 11 against diaphragm spring 19 thus opening the distance between needle valve 11 and seat 10, allowing an increased flow of fuel to proceed through inlet 26 into fuel chamber 2A.

In the preferred embodiment, fuel is supplied to regulator 50 at the middle elevational portion of the regulator 50. This allows a certain level of fuel to accumulate in the fuel chamber 2A and thus prevents the entrance of bubbles (harmful to engine operation) into the line which supplies fuel to carburetor 60. Fuel exits from regulator 50 at a point preferably near the upper elevational portion of regulator 50. A fuel by-pass 65 can be provided in line 65 from bypass outlet 27 to the gas tank 52. This fuel by-pass 65 allows the removal and flow of gas bubbles from the regulator 50 to gasoline tank 52 and thus removes the possibility that air bubbles may be trapped in the fuel line going directly to a further metering system or a conventional carburetor 60. Thus, fuel by-pass outlet 65 can expel any and all trapped air particles which otherwise would accumulate within the regulator 50.

The alternative embodiment of the apparatus of the present invention, designated generally by the numeral 52 in FIG. 5, operates similarly to the apparatus of the preferred embodiment designated generally by the numeral 50 in FIG. 2. In the alternative embodiment, a single diaphragm 8 is provided rather than the dual diaphragm structure of the preferred embodiment. In the alternative embodiment, a single diaphragm provides a division between fuel chamber body 2 and vacuum chamber body 1 forming a vacuum chamber 1A and a fuel chamber 2A on its opposite sides. The flow of fuel is controlled by means of needle valve 11, which abuts clamp screw 6 and reciprocates therewith to provide a minimal flow when diaphragm 8 is urged towards stop screw 4 when a vacuum measure is high and a maximum flow when spring 18 urges clamp screw 6 to push needle valve 11 to an open most position against stop 12 when vacuum measure is low.

Because many varying and differing embodiments may be taught within the scope of the inventive concept herein, and because many modifications may be made in the embodiment herein detailed in accordance with descriptive requirements of the law, it should be understood that the details herein are to be interpreted as illustrative and not in a limiting sense.

What is claimed as invention is:

1. An air-fuel metering regulator for adjusting the flow of fuel to, for example, an internal combustion engine operating under idling, cruising and accelerating power conditions, comprising:

a. a housing;

b. a fuel diaphragm within said housing, said fuel diaphragm and said housing providing a fuel chamber within said housing, and said fuel chamber is provided with a fuel supply inlet and a fuel supply outlet;

c. a vacuum diaphragm within said housing, said vacuum diaphragm and said housing providing a vacuum chamber within said housing, said vacuum chamber provided with an opening to which a supply of engine vacuum pressure is connectable; and d. valve means associated with said fuel chamber for controlling the rate of flow of fuel into said fuel supply inlet into said fuel chamber to said fuel supply outlet, said valve means being actuated by reciprocations of said fuel diaphragm, and said fuel diaphragm is reciprocated by motion of said vacuum diaphragm, said motion of said vacuum diaphragm produced by the supply of engine vacuum pressure connected to said fuel vacuum chamber, said valve means comprising in part maximum flow adjustment means in cooperation with said valve means and externally mounted on said housing for adjusting the maximum flow rate of fuel through said valve means, said valve means further comprising in part minimum flow adjustment means in cooperation with said valve means and externally mounted on said housing for adjusting the minimum flow rate of fuel through said valve means, said valve means being a needle valve having an inner valving needle, said valving needle being urged into contact at its end portion with said fuel diaphragm, and reciprocations of said fuel diaphragm within said fuel chamber producing a corresponding reciprocation in said valving needle and a variation of fuel flow from said inlet through said needle valve into said fuel chamber.

2. The air-fuel metering regulator as defined in claim 1 wherein the maximum flow adjustment means and the minimum flow adjustment means are formed with fine adjustment capabilities designed to give greater flexibilities and control for precise metering.

3. The apparatus of claim 1, wherein there is provided needle adjustment means for fixing the reciprocation distance of said valving needle within said needle valve.

4. The apparatus of claim 3, wherein said needle adjustment means is externally adjustable from without said housing.

5. The apparatus of claim 1, wherein there is further provided by-pass means for removing gaseous matter from said fuel chamber.

6. The apparatus of claim 1 wherein there is further provided needle adjustment means for fixing the reciprocation distance of said valving needle within said needle valve.

7. The apparatus of claim 6 wherein said needle adjustment means is externally adjustable from without said housing.

* * * * *